US008292037B2

(12) United States Patent
Kawamura et al.

(10) Patent No.: US 8,292,037 B2
(45) Date of Patent: Oct. 23, 2012

(54) ENGINE LUBRICATION SYSTEM

(75) Inventors: Hiroshi Kawamura, Okazaki (JP); Shunji Mamiya, Iwata (JP); Noboru Nowatari, Iwata (JP); Hitoshi Uema, Iwata (JP)

(73) Assignees: Toyota Jidosha Kabushiki Kaisha, Toyota-shi (JP); Yamaha Hatsudoki Kabushiki Kaisha, Iwata-shi (JP)

( * ) Notice: Subject to any disclaimer, the term of this patent is extended or adjusted under 35 U.S.C. 154(b) by 530 days.

(21) Appl. No.: 12/394,820

(22) Filed: Feb. 27, 2009

(65) Prior Publication Data

US 2009/0218169 A1 Sep. 3, 2009

(30) Foreign Application Priority Data

Feb. 29, 2008 (JP) ..... 2008-049716

(51) Int. Cl.
*F01M 1/02* (2006.01)

(52) U.S. Cl. ..... 184/6.5; 184/106; 184/1.5; 123/196 R

(58) Field of Classification Search ..... 184/6.5, 184/106, 1.5; 123/196 R
See application file for complete search history.

(56) References Cited

U.S. PATENT DOCUMENTS

| | | | | |
|---|---|---|---|---|
| 3,554,322 | A * | 1/1971 | Deutschmann et al. | 184/6.2 |
| 4,674,457 | A * | 6/1987 | Berger et al. | 123/196 R |
| 4,762,201 | A * | 8/1988 | Malik | 184/6.13 |
| 5,101,936 | A * | 4/1992 | Paredes et al. | 184/6.13 |
| 5,279,391 | A * | 1/1994 | Ward | 184/6.12 |
| 5,517,959 | A * | 5/1996 | Kato et al. | 123/196 AB |
| 6,029,638 | A * | 2/2000 | Funai et al. | 123/572 |
| 6,390,240 | B1 * | 5/2002 | Schmidt et al. | 184/6.3 |
| 6,823,967 | B1 * | 11/2004 | Hoi et al. | 184/6.9 |
| 6,848,528 | B2 * | 2/2005 | Pichler et al. | 180/190 |
| 7,017,546 | B1 * | 3/2006 | Patel et al. | 123/196 R |
| 7,040,454 | B2 * | 5/2006 | Kawamoto et al. | 184/106 |
| 7,100,562 | B2 * | 9/2006 | Terada et al. | 123/195 R |
| 7,174,876 | B2 * | 2/2007 | Suzuki et al. | 123/196 R |
| 7,267,094 | B2 * | 9/2007 | Tawarada et al. | 123/196 M |

FOREIGN PATENT DOCUMENTS

| | | |
|---|---|---|
| JP | 3052002 | 4/2000 |
| JP | 2000-227016 | 8/2000 |
| JP | 2004-156451 | 6/2004 |
| JP | 2005-282568 | 10/2005 |
| JP | 2007-2806 | 1/2007 |

OTHER PUBLICATIONS

German Office Action issued Apr. 5, 2011, in Patent Application No. 10 2009 003 543.5 (with English-language translation).

* cited by examiner

*Primary Examiner* — William E Dondero
*Assistant Examiner* — Michael Riegelman
(74) *Attorney, Agent, or Firm* — Oblon, Spivak, McClelland, Maier & Neustadt, L.L.P.

(57) ABSTRACT

An engine lubrication system for a multi-cylinder engine, comprising: plurality of crank chambers that are partitioned by crankshaft bearing portions of the engine; pumps that take out oil from a lower portion of the engine; oil collection passages that are respectively provided for the crank chambers, a designated number of the oil collection passages being merged and connected to at least one of suction ports of the pumps; an oil storage section that temporarily stores the oil taken out from the lower portion of the engine; a lubrication part that supplies the oil in the oil storage section to a portion to be lubricated of the engine; and a pressure variation suppression section that is provided between the suction ports of the pumps and the designated number of the crank chambers to be merged, the pressure variation suppression section suppressing pressure variations in the crank chambers.

11 Claims, 11 Drawing Sheets

ENGINE LUBRICATION SYSTEM

INCORPORATION BY REFERENCE

The disclosure of Japanese Patent Application No. 2008-049716 filed on Feb. 29, 2008, including the specification, drawings and abstract is incorporated herein by reference in its entirety.

BACKGROUND OF THE INVENTION

1. Field of Invention

The present invention relates to a lubrication system installed in a multi-cylinder engine (internal combustion engine) for vehicles such as automobiles, for example. In particular, the present invention provides a so-called dry-sump lubrication system.

2. Description of Related Art

In general, a dry-sump lubrication system takes out oil and blow-by gas from the lower portion of the engine with a scavenge pump and temporarily stores the oil in an oil tank located separately from the crank chamber. The lubrication system supplies the oil in the oil tank with a feed pump to portions of the engine to be lubricated, where lubrication or temperature adjustment (cooling or heating) is required. Thus, friction at sliding and rolling portions is reduced, and temperature adjustment (cooling or heating) is performed in various portions of the engine.

According to the dry-sump lubrication system, the oil storage space, which is provided in the lower portion of the engine in the related art, can be made significantly small, or even omitted, which allows downsizing of the engine and lowering the center of gravity of the engine. Besides, oil can be stored stably in the oil tank, and therefore can be prevented from leaning to one side or foaming in the crank chamber. Oil can thus be stably supplied to the portions of the engine to be lubricated.

In the lubrication systems disclosed in Japanese Patent Application Publication No. 2000-227016 (JP-A-2000-227016) and Japanese Patent Application Publication No. 2004-156451 (JP-A-2004-156451), oil in the oil pan provided at the lower portion of the engine is taken out by a single oil pump. In JP-A-2000-227016 and JP-A-2004-156451, the arrangement of components such as the oil collection passage and the scavenge pump is not described in detail.

Moreover, Japanese Patent Application Publication No. 2007-2806 (JP-A-2007-2806) discloses a multi-cylinder engine equipped with a lubrication system, in which oil at the bottoms of separately partitioned crank chambers is permitted to drop from oil discharge ports that are opened in the bottoms of the crank chambers into a single oil collection chamber located under the crank chambers. The oil in the oil collection chamber is taken out by a single scavenge pump.

This related art is disadvantageous in lowering the center of gravity of the engine since the oil collection chamber is located under the crank chambers of the engine. In addition, since the engine is a multi-cylinder engine, in which a plurality of pistons move up and down at different timings each other, the phases of pressure variations that occur in the crank chambers are also different. This increases the pressure difference between the crank chambers. Therefore, it is concerned that the oil in the oil collection chamber may flow back into crank chambers at a negative pressure, and that the scavenge pump may not be able to smoothly collect the oil.

Although the lubrication systems in accordance with the above related arts use a single scavenge pump and are therefore advantageous in terms of cost, weight, and installation space, the oil collection efficiency may be low as discussed above.

Japanese Patent No. 3052002 discloses an arrangement for a single-cylinder engine equipped with a dry-sump lubrication system, in which an oil path extending from a scavenge pump to an oil tank is formed in the mating surfaces of a crankcase and a crankcase cover of the engine. This lubrication system, however, relates to a single-cylinder engine and does not relate to a multi-cylinder engine. Japanese Patent No. 3052002 discloses that the lubrication system is also applicable to multi-cylinder engines, but does not at all disclose how the lubrication system can be applied to the multi-cylinder engines.

SUMMARY OF THE INVENTION

The present invention provides a dry-sump lubrication system installed in a multi-cylinder engine of which cost, weight, and installation space can be reduced by using a small number of pumps, and which can still secure a necessary and sufficient oil collection capacity.

An aspect of the present invention relates to an engine lubrication system. The lubrication system takes out oil from a lower portion of a multi-cylinder engine with pumps, temporarily stores the oil in an oil storage section that is located separately from the engine, and supplies the oil in the oil storage section to a portion to be lubricated of the engine. In this lubrication system, the number of the pumps to be used is at least one and less than the number of crank chambers of the engine partitioned by crankshaft bearing portions. Oil collection passages are respectively provided for the crank chambers. A designated number of the oil collection passages are merged and connected to at least one of suction ports of the pumps. A pressure variation suppression section is provided between the suction port of the pump and the designated number of the crank chambers to be merged. The pressure variation suppression section suppresses pressure variations in the crank chambers.

The lubrication system in accordance with the aspect of the present invention is assumed to be a dry-sump lubrication system. This lubrication system makes it possible to reduce the stirring resistance of the oil in the crank chambers, and to lower the center of gravity of the engine.

In the lubrication system in accordance with the aspect of the present invention, the internal space of the crankcase is partitioned by the crankshaft bearing portions to form a plurality of crank chambers, and a smaller number of pumps than the number of the crank chambers are used. Therefore, the number of pumps to be used may be reduced compared to the related art in which a pump for taking out oil is provided for each of the crank chambers, for example. Thus, the cost, the weight, and the installation space of the lubrication system can be reduced.

In the lubrication system in accordance with the aspect of the present invention, the crank chambers are separately partitioned. Therefore, it is possible to prevent the occurrence of trouble in such a case that a smaller number of pumps than the number of crank chambers are used. That is, oil to be collected may be prevented from flowing back to the crank chamber because of mutual interference between pressure variations that occur in each of the crank chambers. Moreover, the pressure variation suppression section can effectively diminish pulsations of oil and blow-by gas taken out from the crank chambers due to pressure variations that occur in the crank chambers to be merged.

According to these characteristics, oil can be smoothly collected by the pumps, which enables oil to smoothly return to the oil tank without retention in the crank chambers. Further, oil can be stably supplied to the portion to be lubricated of the engine. Thus, it is possible to reduce friction in the crank chambers, and to improve lubrication and temperature adjustment (cooling or heating) of the engine.

In the lubrication system, those crank chambers between which pressure difference is minimum may be selected as the designated number of the crank chambers to be merged.

In the lubrication system, those crank chambers in which pressure variations are in the same phase may be selected as the designated number of the crank chambers to be merged.

In the lubrication system, those crank chambers between which pressure difference is minimum may be selected as the designated number of the crank chambers to be merged, and the pressure variation suppression section may include the oil collection passages that are connected to the respective crank chambers such that the oil collection passages have a designated length and a designated inner diameter that are required to suppress pressure variations in the respective crank chambers.

In this structure, of the multiplicity of separately partitioned crank chambers, those crank chambers in which pressure variations are synchronized are together subjected to oil collection by a common pump. Therefore, oil in the oil collection passages can be prevented from flowing back into a crank chamber in which the pressure is low (negative) because of the pressure difference between the crank chambers.

In addition, the pressure variation suppression section includes the oil collection passages with adjusted length and inner diameter. This eliminates the need to add an extra member, but simplifies the structure and thus is advantageous in reducing the cost.

The oil collection passages may have the same length from a point at which each oil collection passage is connected to a corresponding crank chamber to a point at which the oil collection passages are merged.

Those crank chambers between which pressure difference is minimum may be selected as the designated number of the crank chambers to be merged, the pressure variation suppression section may include chambers to which downstream sides of the oil collection passages to be merged are respectively connected, the chambers having a specific volume that is required to suppress pressure variations in the crank chambers corresponding to the oil collection passages, and the chambers may be connected to the suction ports of the pumps though a single common passage.

In this structure, of the multiplicity of crank chambers separately partitioned by the crankshaft bearing portions, those crank chambers between which pressure difference is minimum are together subjected to oil collection by a common pump. Therefore, oil in the oil collection passages can be prevented from flowing back into a crank chamber in which the pressure is low (negative) because of the pressure difference between the crank chambers.

In addition, the chambers as the pressure variation suppression section can effectively diminish pulsations of oil and blow-by gas taken out from the crank chambers due to pressure variations that occur in the crank chambers to be merged. Therefore, oil can be smoothly collected by the pumps. As described above, the oil collection efficiency can be enhanced with minimum addition of components besides the chambers used as the pressure variation suppression section.

The oil collection passages may be formed integrally in a plate-like member attached to a lower side of the crank chambers.

In this structure, the oil collection passages are not formed by a tubular member routed around the engine such as a pipe or a hose, but formed integrally in an existing plate-like member attached to the lower portion of the engine. This reduces the number of parts and the installation work and thus is advantageous in terms of cost. The plate-like member may be an oil pan or a lower plate.

In the case where an even number of the crank chambers are provided, every two crank chambers between which pressure difference is minimum may be paired, and the number of the pumps may be the same as the number of pairs of the crank chambers.

This structure specifies the number of the pumps and the combination of the crank chambers to be merged for simultaneous oil collection, and thus enables the construction of a preferred embodiment.

In the case where an odd number of the crank chambers are provided, one pump may be connected to one crank chamber positioned centrally in a direction in which cylinders are arranged, and every two other crank chambers between which pressure difference is minimum may each be connected to one pump using an oil collection passage with a 2-in-1 construction.

This structure specifies the number of the pumps and the combination of the crank chambers to be merged for simultaneous oil collection, and thus enables the construction of a preferred embodiment.

The pumps may each be a mechanical oil pump.

The pumps may each be an electric oil pump.

According to the lubrication system in accordance with the aspect of the present invention, the cost, the weight, and the installation space of a dry-sump lubrication system installed in a multi-cylinder engine by using a smaller number of pumps can be reduced. In addition, a necessary and sufficient oil collection capacity can still be secured. Thus, it is possible to reduce friction in the crank chambers, and to improve lubrication and temperature adjustment (cooling or heating) of the engine, thereby enabling the construction of a low-cost, lightweight, and space-saving engine that has still high-performance and reliability.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Hereinafter, a detailed description will be made of embodiments of the present invention with reference to the drawings. Herein, a dry-sump lubrication system installed in a multi-cylinder engine mounted in vehicles such as automobiles is taken as an example.

First Embodiment

FIGS. 1 to 4 show a first embodiment of the present invention. First, the dry-sump system will be briefly described with reference to FIG. 1.

Figure 1:
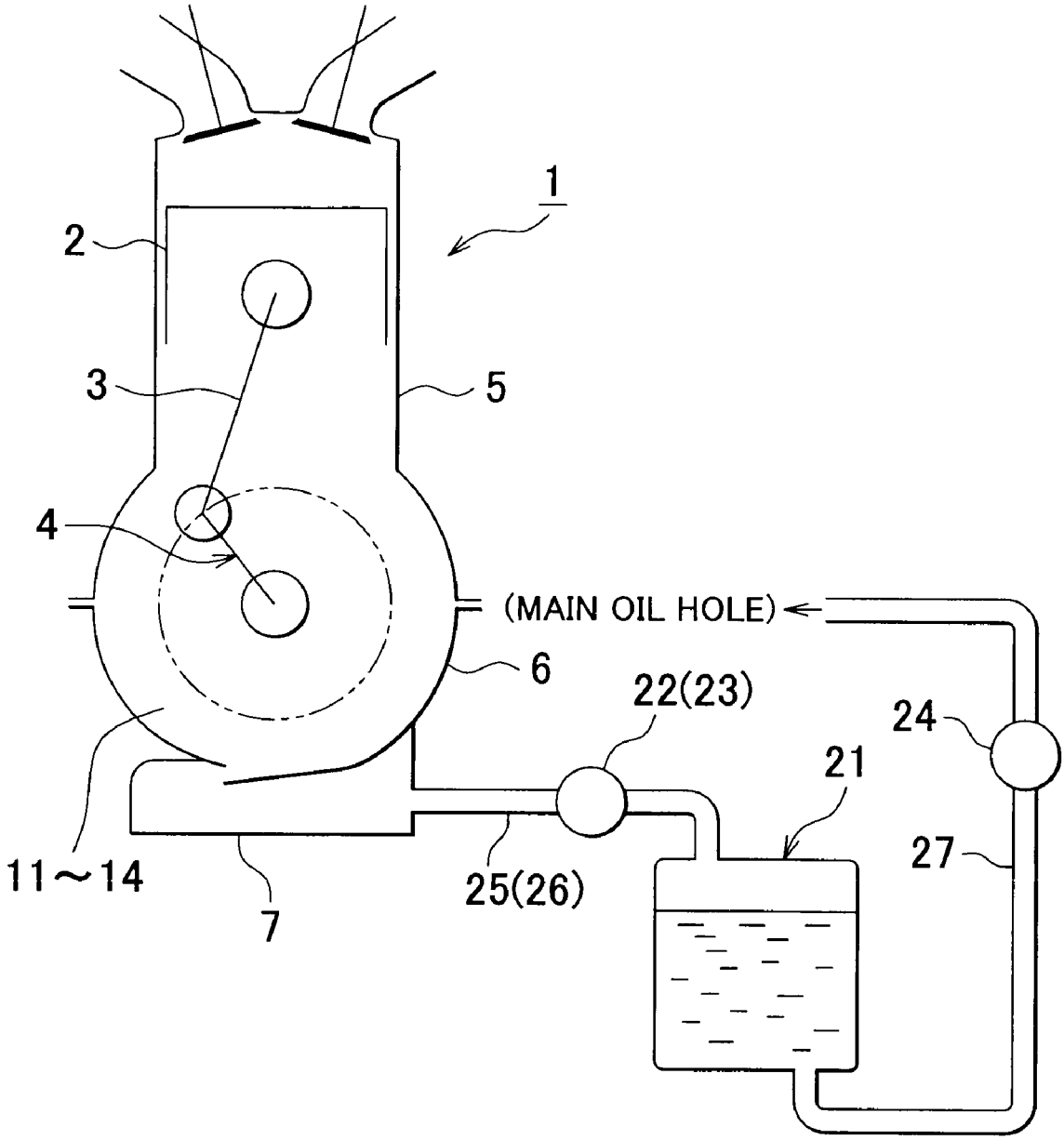
FIG. 1 is a view showing the schematic structure of an engine lubrication system in accordance with a first embodiment of the present invention.

FIG. 1 shows an inline 4-cylinder engine 1 as viewed from the front side of the vehicle. As shown in the drawing, the engine 1 is provided with cylinders (no reference numeral given) arranged in line (in the direction perpendicular to the sheet surface of FIG. 1), and pistons 2 are housed in the respective cylinders so as to be vertically reciprocable.

Reciprocal motion of the pistons 2 is converted into rotational motion of a crankshaft 4 via connecting rods 3. Oil is supplied to sliding portions of the pistons 2 and the cylinders and bearing portions of the connecting rods 3 and the crankshaft 4, in order to reduce friction at sliding and rolling portions and perform temperature adjustment (cooling or heating) in various portions of the engine 1.

The engine 1 is equipped with a dry-sump lubrication system. The dry-sump lubrication system takes out oil from the lower portion of the engine 1 and temporarily stores the oil in an oil tank 21 as an oil storage section that is located separately outside the engine 1. Although not shown, the lubrication system supplies the oil stored in the oil tank 21 to portions to be lubricated in a cylinder block 5 via an oil supply path on the cylinder block side, which is referred to as "main oil hole" or "main gallery." The lubrication system also supplies the oil stored in the oil tank 21 to portions to be lubricated in a cylinder head via an oil supply path on the cylinder head side. The oil after use is collected in the lower portion of the engine 1.

Now, this embodiment will be described with reference to FIGS. 2 to 4.

In this embodiment, the internal space of a crankcase 6 is partitioned into a plurality of crank chambers 11 to 14. A contrivance is made to efficiently return the oil in the crank chambers 11 to 14 to an oil tank 21 using a smaller number of scavenge pumps 22, 23 than the number of the crank chambers 11 to 14.

A specific description is as follows. A crankcase 6 is attached to the lower portion of the cylinder block 5 of the engine 1. The crankcase 6 is shaped so as to cover the crankshaft 4.

The internal space of the crankcase 6 is partitioned by crankshaft bearing portions in a mutually incommunicable manner, in order to form a plurality of (four in this embodiment) partitioned crank chambers 11 to 14.

In the case of an inline multi-cylinder engine, the number of the thus partitioned crank chambers 11 to 14 may be the same as that of the cylinders. In other words, the number of the crank chambers 11 to 14 may be the same as that of crank pins (not shown) of the crankshaft 4, to which the big ends (not shown) of the connecting rods 3 are coupled.

The crank chambers 11 to 14 are communicated with the respective cylinders (no reference numeral given) of the cylinder block 5. Therefore, pressure variations that occur in each of the separately partitioned crank chambers 11 to 14 as the piston 2 moves up and down does not interfere with each other.

As described above, oil and blow-by gas collected in the four partitioned crank chambers 11 to 14 are taken out by the two scavenge pumps 22, 23, for example, and fed to the oil tank 21.

The first scavenge pump 22 takes out oil in the crank chamber 11 corresponding to a first cylinder and the crank chamber 14 corresponding to a fourth cylinder. Meanwhile, the second scavenge pump 23 takes out oil in the crank chamber 12 corresponding to a second cylinder and the crank chamber 13 corresponding to a third cylinder.

As described above, two scavenge pumps 22, 23 are used. The two scavenge pumps 22, 23 and the four crank chambers 11 to 14 are connected with two oil collection passages 25, 26 as described below.

One (upstream) end of each of the two oil collection passages 25, 26 is bifurcated into two passages. Meanwhile, the other (downstream) end of each of the two oil collection passages 25, 26 is merged as one. That is, the oil collection passages 25, 26 have a so-called 2-in-1 construction.

Bifurcated upstream branched portions 25*a*, 25*b* of the first oil collection passage 25 are separately connected to the first and fourth crank chambers 11 and 14, for example. A downstream merged portion 25*c* of the first oil collection passage 25 is connected to the suction port of the first scavenge pump 22.

On the other hand, bifurcated upstream branched portions 26*a*, 26*b* of the second oil collection passage 26 are separately connected to the second and third crank chambers 12 and 13, for example. A downstream merged portion 26*c* of the second oil collection passage 26 is connected to the suction port of the second scavenge pump 23.

Here, in the case of an inline 4-cylinder engine, for example, the selection of which the bifurcated upstream branched portions 25*a*, 25*b*, 26*a*, 26*b* of the two oil collection passages 25, 26 is to be connected to which of the crank chambers 11 to 14 is preferably determined in such a manner that crank chambers where corresponding pistons 2 move up and down in synchronization are combined. With such a combination, the pressure difference between the combined crank chambers can be made minimum.

In the inline 4-cylinder engine 1, in general, the first piston and the fourth piston, and the second piston and the third piston, are respectively combined to move up and down in synchronization, in order to optimize the rotation balance of the crankshaft 4. The combination of the crank chambers 11 to 14 is thus selected.

In this way, although pressure variations occur in each of the separately partitioned crank chambers 11 to 14, pressure variations that occur in the two combined crank chambers (11, 14), (12, 13) are generally in the same phase.

That is, during a process in which the piston 2 moves down from the top dead center to the bottom dead center in the two combined cylinders, a positive pressure is produced in both the two corresponding crank chambers (11, 14), (12, 13). Meanwhile, during a process in which the piston 2 moves up from the bottom dead center to the top dead center in the two combined cylinders, a negative pressure is produced in both the two corresponding crank chambers (11, 14), (12, 13).

Thus, the scavenge pumps 22, 23 preferably have such a capacity as to always keep the crank chambers 11 to 14 at a negative pressure, and to overcome a maximum negative pressure produced in the crank chambers 11 to 14 when the piston 2 moves up to the top dead center so that oil taken out from the crank chambers 11 to 14 to the scavenge pumps 22, 23 side will not flow back into the crank chambers 11 to 14.

As shown in FIG. 1, the downstream ends of the two oil collection passages 25, 26 discussed above, namely the downstream merged portions 25*c*, 26*c*, are connected to the upper surface of the oil tank 21. An oil supply passage 27 that guides oil to the engine 1 side is connected to the bottom of the oil tank 21.

A feed pump 24 is provided in an intermediate portion of the oil supply passage 27. The feed pump 24 is adapted to take out oil in the oil tank 21 and supply the oil to portions of the engine 1 to be lubricated.

In an appropriate downstream portion of the oil supply passage 27, an oil strainer or the like (not shown) may be provided that filters oil to remove wear metal powder, sludge, etc., in the oil.

In this embodiment, the two scavenge pumps 22, 23 and the feed pump 24 may each be a mechanical oil pump such as a trochoid pump or a gear pump. The scavenge pumps 22, 23 and the feed pump 24 are disposed with their rotational axes coaxially so that they can be driven by the crankshaft 4 of the engine 1 simultaneously.

Therefore, the scavenge pumps 22, 23 are automatically driven simultaneously when the engine is operated. As a result, oil and blow-by gas collected in the crank chambers 11 to 14 are returned to the oil tank 21, and the oil in the oil tank 21 is supplied again to the portions of the engine 1 to be lubricated through the oil supply passage 27. Oil is thus circulated in a closed loop.

The lengths and inner diameters of the oil collection passages 25, 26 with the 2-in-1 construction discussed above are set to such values that are required to sufficiently diminish pulsations of oil and blow-by gas due to pressure variations that occur in each pair of combined crank chambers (11, 14), (12, 13) so that the pulsations will not be propagated to the two scavenge pumps 22, 23. The length and inner diameter can be set empirically by experiments or the like.

It should be noted, however, that the lengths of the bifurcated upstream branched portions 25*a*, 25*b*, 26*a*, 26*b* of the two oil collection passages 25, 26, that is, the lengths from the upstream ends of the upstream branched portions 25*a*, 25*b*, 26*a*, 26*b* to the merged point, is preferably but not necessarily the same as each other. In this case, for example, the lengths of the bifurcated upstream branched portions 25*a*, 25*b*, 26*a*, 26*b* of the two oil collection passages 25, 26 are preferably set to such values that allow pressure variations that occur in each pair of combined crank chambers (11, 14), (12, 13) to reach the merged portion of the oil collection passages 25, 26 in the same phase.

Figure 2:
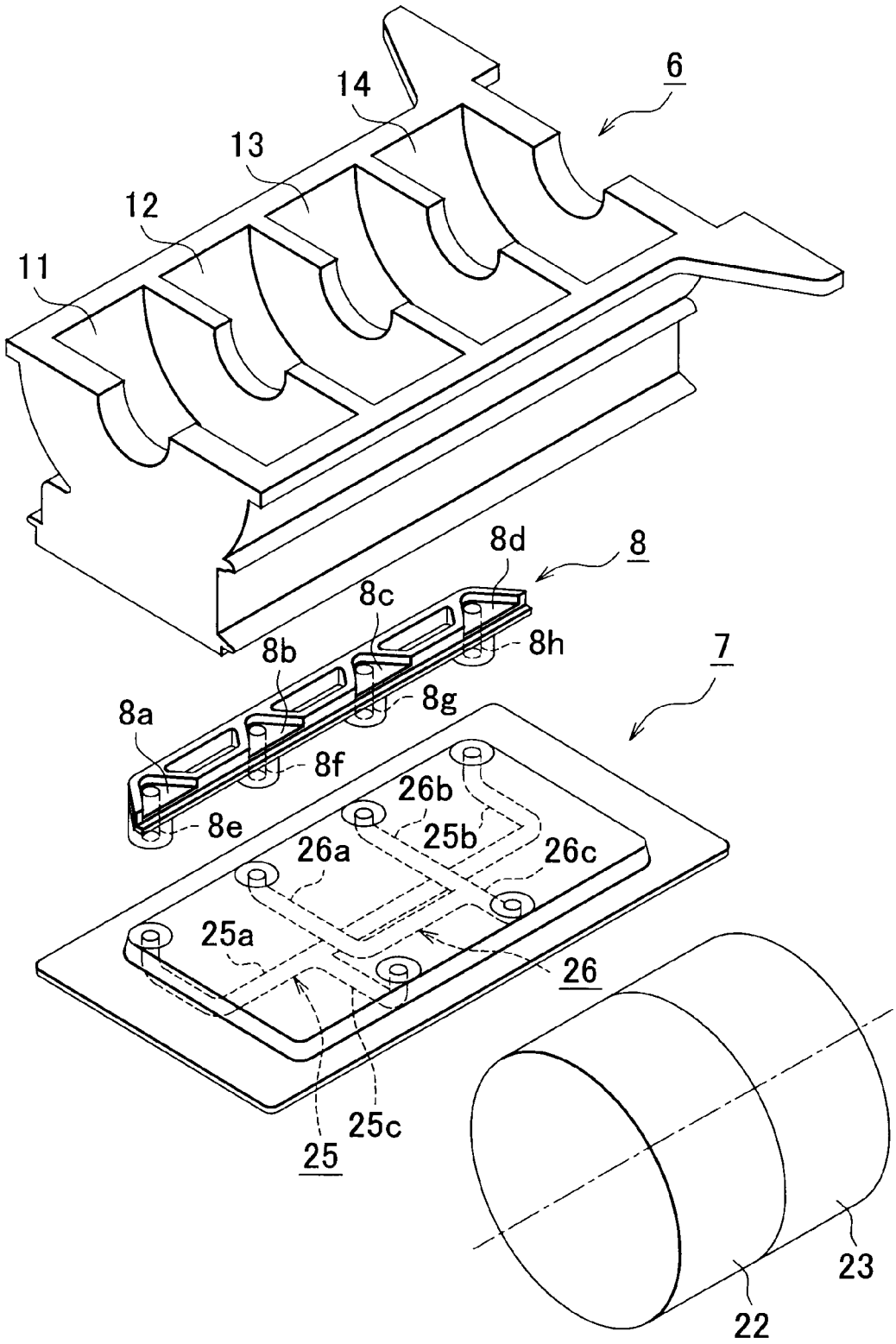
FIG. 2 is an exploded perspective view of elements forming an engine oil collection path in the lubrication system in accordance with the first embodiment.
Figure 3:
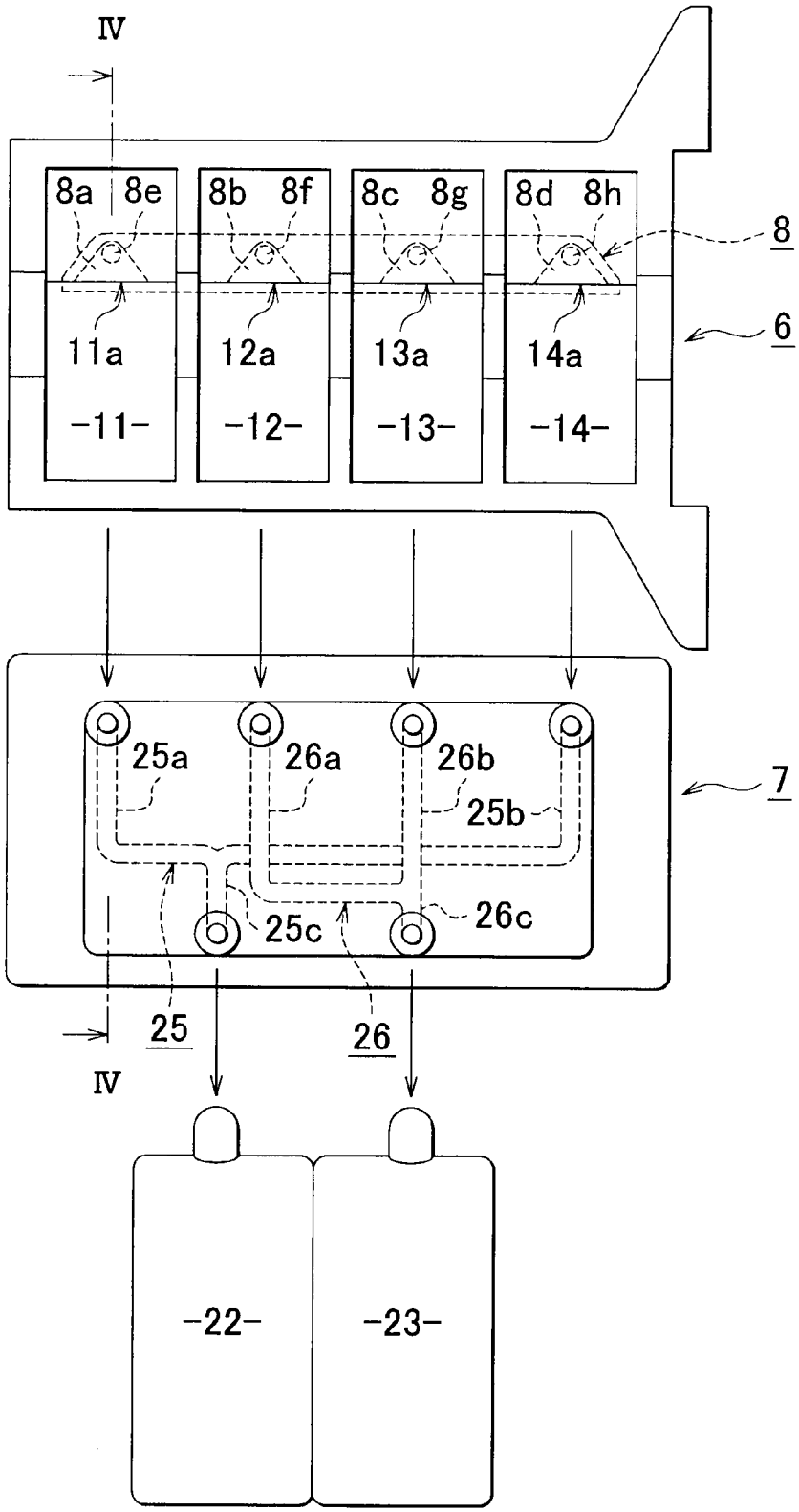
FIG. 3 is a plan view of the elements shown in FIG. 2.
Figure 4:
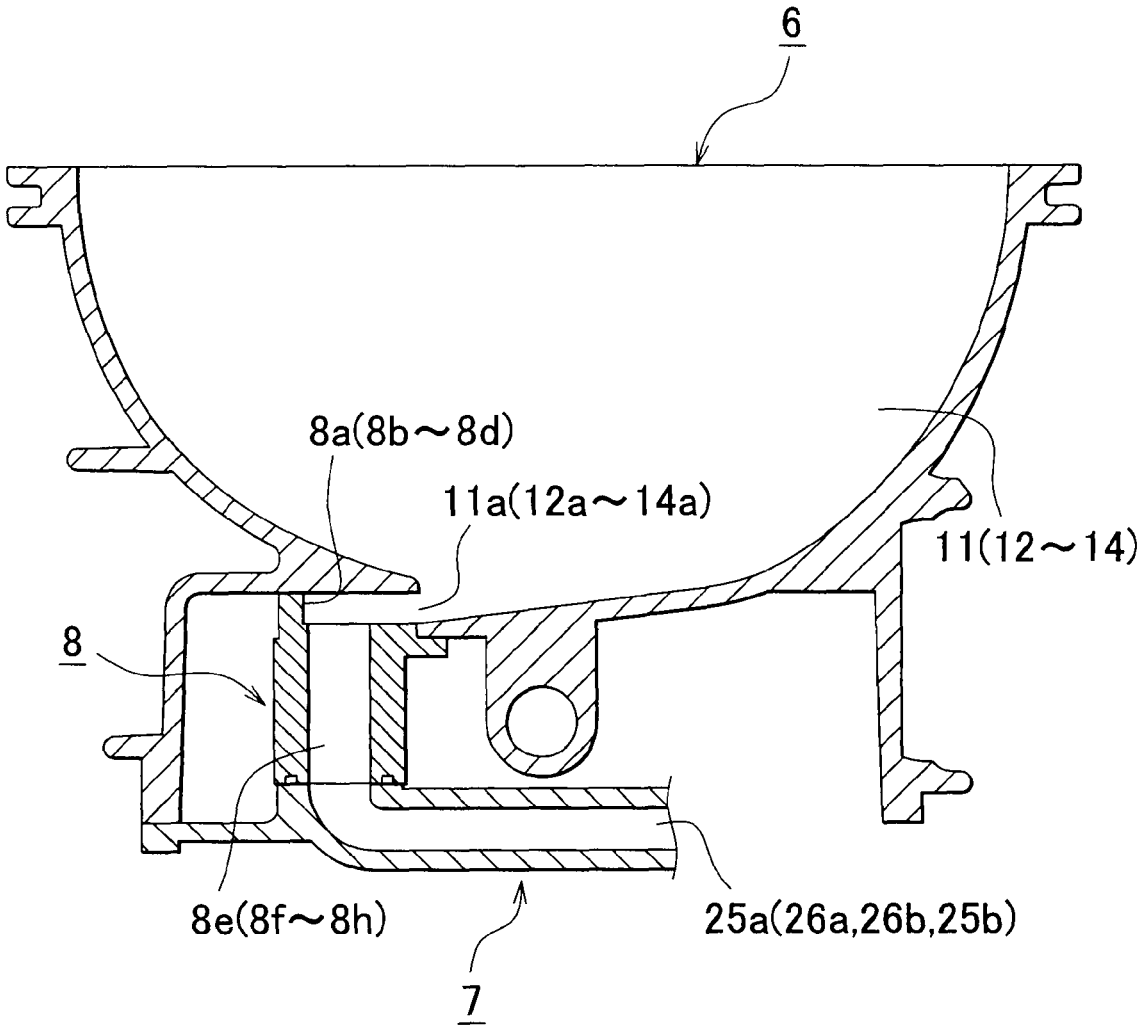
FIG. 4 is a cross sectional view taken along the line IV-IV of FIG. 3 as viewed in the direction of the arrows.

In this embodiment, the two oil collection passages 25, 26 are not formed by a tubular member such as a pipe or a hose, but formed integrally in an oil pan 7 attached to the lower portion of the crankcase 6, as shown in FIGS. 2 and 3. This structure will be described in detail below.

Here, the oil pan 7 is not in the shape of a container that can store oil, but is merely a plate-like member. The oil pan 7 in this embodiment is attached to the lower portion of the engine 1 and does not store oil. Therefore, the oil pan 7 may simply be referred to as "lower plate".

The oil collection passages 25, 26 are formed as holes that are formed inside the oil pan 7, with the openings of the bifurcated upstream branched portions 25*a*, 25*b*, 26*a*, 26*b* and the openings of the downstream merged portions 25*c*, 26*c* each formed in the upper surface of the oil pan 7.

The openings of the bifurcated upstream branched portions 25*a*, 25*b*, 26*a*, 26*b* of the two oil collection passages 25, 26 formed in the oil pan 7 are separately connected via a baffle plate 8 to oil discharge ports 11*a*, 12*a*, 13*a*, 14*a* (see FIGS. 3 and 4) respectively formed in the bottoms of the crank chambers 11 to 14.

Meanwhile, the openings of the downstream merged portions 25*c*, 26*c* of the two oil collection passages 25, 26 formed in the oil pan 7 are separately connected to the suction ports of the two scavenge pumps 22, 23.

The thus constructed oil pan 7 can be made of an aluminum alloy by casting, for example. In this case, the holes corresponding to the oil collection passages 25, 26 can be formed using a sand mold or the like as a core.

The baffle plate 8 includes a generally rectangular plate-like portion and four cylindrical portions formed at the lower surface of the plate-like portion, and is reduced in weight. The baffle plate 8 has four oil receiving portions 8*a* to 8*d* and four through holes 8*e* to 8*h*.

The four oil receiving portions 8*a* to 8*d* are formed in the upper surface of the plate-like portion of the baffle plate 8 and arranged in line in the longitudinal direction of the baffle plate 8. The oil receiving portions 8*a* to 8*d* are formed to separately receive and collect oil that is discharged from the oil discharge ports 11*a* to 14*a* of the respective crank chambers 11 to 14.

The oil receiving portions 8*a* to 8*d* each have vertical walls arranged in a V-shape as viewed in plan so as to separately cover and surround the oil discharge ports 11*a* to 14*a* that are formed to open in the horizontal direction in the bottoms of the respective crank chambers 11 to 14.

The four through holes 8*e* to 8*h* are formed to extend from the plate-like portion of the baffle plate 8 in the thickness direction of the cylindrical portions, namely the vertical direction. The upper openings of the four through holes 8*e* to 8*h* are formed in the narrow portions of the V-shaped oil receiving portions 8*a* to 8*b*, while the lower openings of the through holes 8*e* to 8*h* are formed in the lower ends of the cylindrical portions of the baffle plate 8.

The lower openings of the through holes 8*e* to 8*h* are communicatively coupled to the bifurcated upstream branched portions 25*a*, 25*b*, 26*a*, 26*b* of the two oil collection passages 25, 26 formed in the oil pan 7.

Since the oil receiving portions 8*a* to 8*d* are formed in a V-shape and the upper openings of the through holes 8*e* to 8*h* are located in the inner corner of the V-shape as described above, oil and blow-by gas discharged from the crank chambers 11 to 14 can be collected and guided to the through holes 8*e* to 8*h*.

When the engine 1 is operated in the first embodiment discussed above, the two scavenge pumps 22, 23 and the feed pump 24 are driven simultaneously along with rotation of the crankshaft 4. As a result, oil is circulated as discussed above to lubricate or cool, the portions of the engine 1 to be lubricated.

At this time, the first scavenge pump 22 collects oil and blow-by gas in the first crank chamber 11 and the fourth crank chamber 14, while the second scavenge pump 23 collects oil and blow-by gas in the second crank chamber 12 and the third crank chamber 13. The oil and blow-by gas flows through the two oil collection passages 25, 26 with a 2-in-1 construction. The two oil collection passages 25, 26 are adapted to effectively diminish pulsations of the oil and blow-by gas due to pressure variations that occur in each pair of crank chambers (11, 14), (12, 13).

As has been described above, according to the lubrication system in accordance with the first embodiment of the present invention, the number of scavenge pumps to be used can be reduced compared to the related art in which a scavenge pump is provided for every crank chamber, for example. Therefore, it is possible to reduce friction, the cost, the weight, and the installation space of the lubrication system.

In addition, of the four separately partitioned crank chambers 11 to 14, two crank chambers (11, 14), (12, 13) in which pressure variations are synchronized are together subjected to oil collection by one of the two scavenge pumps 22, 23. Therefore, it is possible to prevent the occurrence of trouble that may occur in the case where a smaller number of scavenge pumps 22, 23 than the number of crank chambers 11 to 14 are used. That is, oil in the oil collection passages 25, 26 can be prevented from flowing back into one of the crank chambers in which the pressure is low (negative) because of the pressure difference between each pair of two crank chambers (11, 14), (12, 13).

Moreover, the two oil collection passages 25, 26, which serve as a pressure variation suppression section, can effectively diminish pulsations of oil and blow-by gas taken out from the crank chambers 11 to 14 due to pressure variations that occur in the crank chambers (11, 14), (12, 13) to be merged.

These characteristics are combined to provide a synergistic function. Smooth oil collection by the scavenge pumps 22, 23 enables oil to smoothly return to the oil tank 21 without permitting oil to retain in the crank chambers 11 to 14. Further, oil can be stably supplied to the portions of the engine 1 to be lubricated.

Thus, it is possible to reduce friction in the crank chambers 11 to 14, and to improve lubrication and temperature adjustment of the engine 1, thereby enabling the construction of a low-cost engine 1 that has still high-performance and reliability.

Second Embodiment

Figure 5:
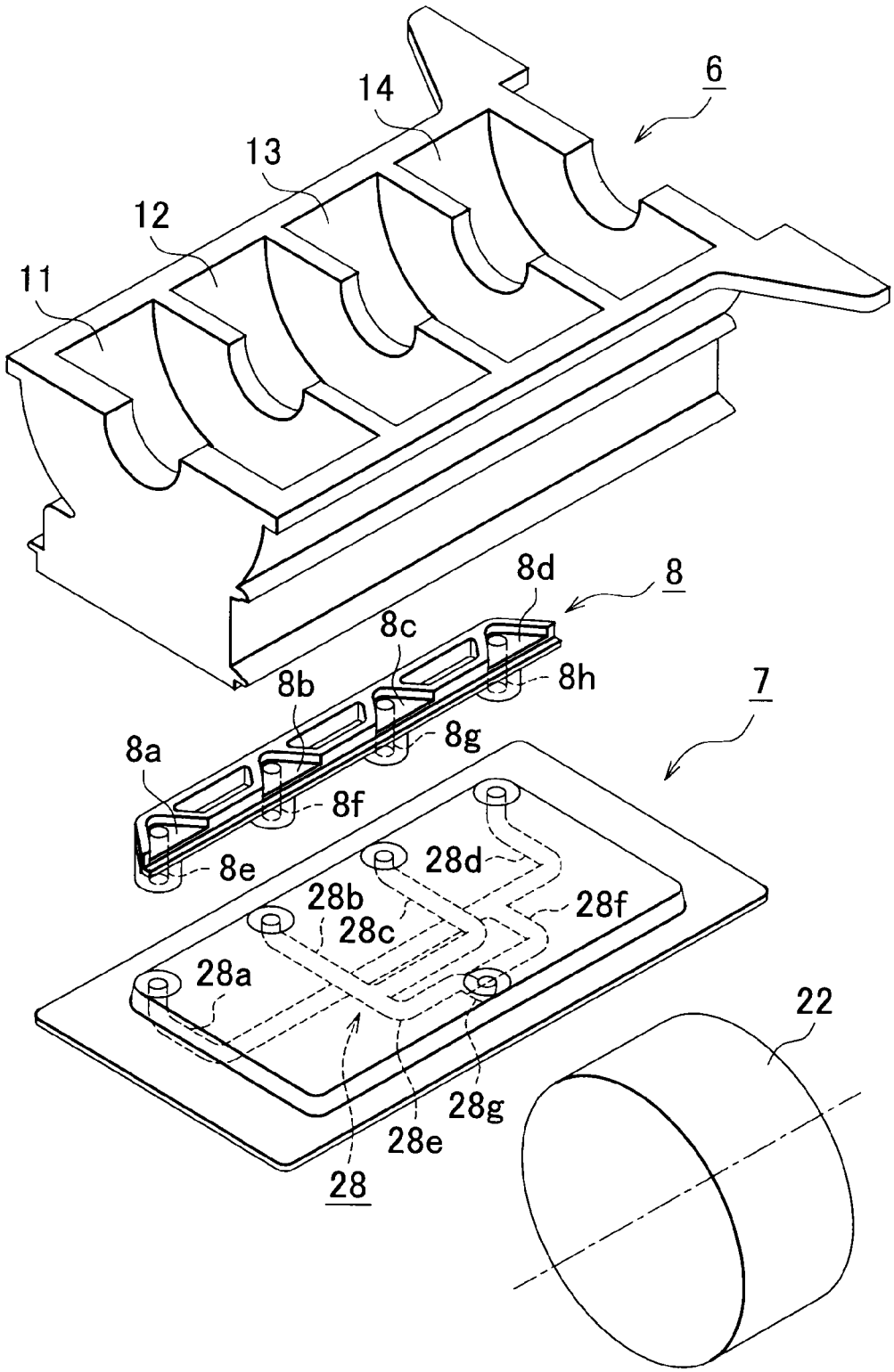
FIG. 5 is an exploded perspective view of elements forming an engine oil collection path in an engine lubrication system in accordance with a second embodiment.
Figure 6:
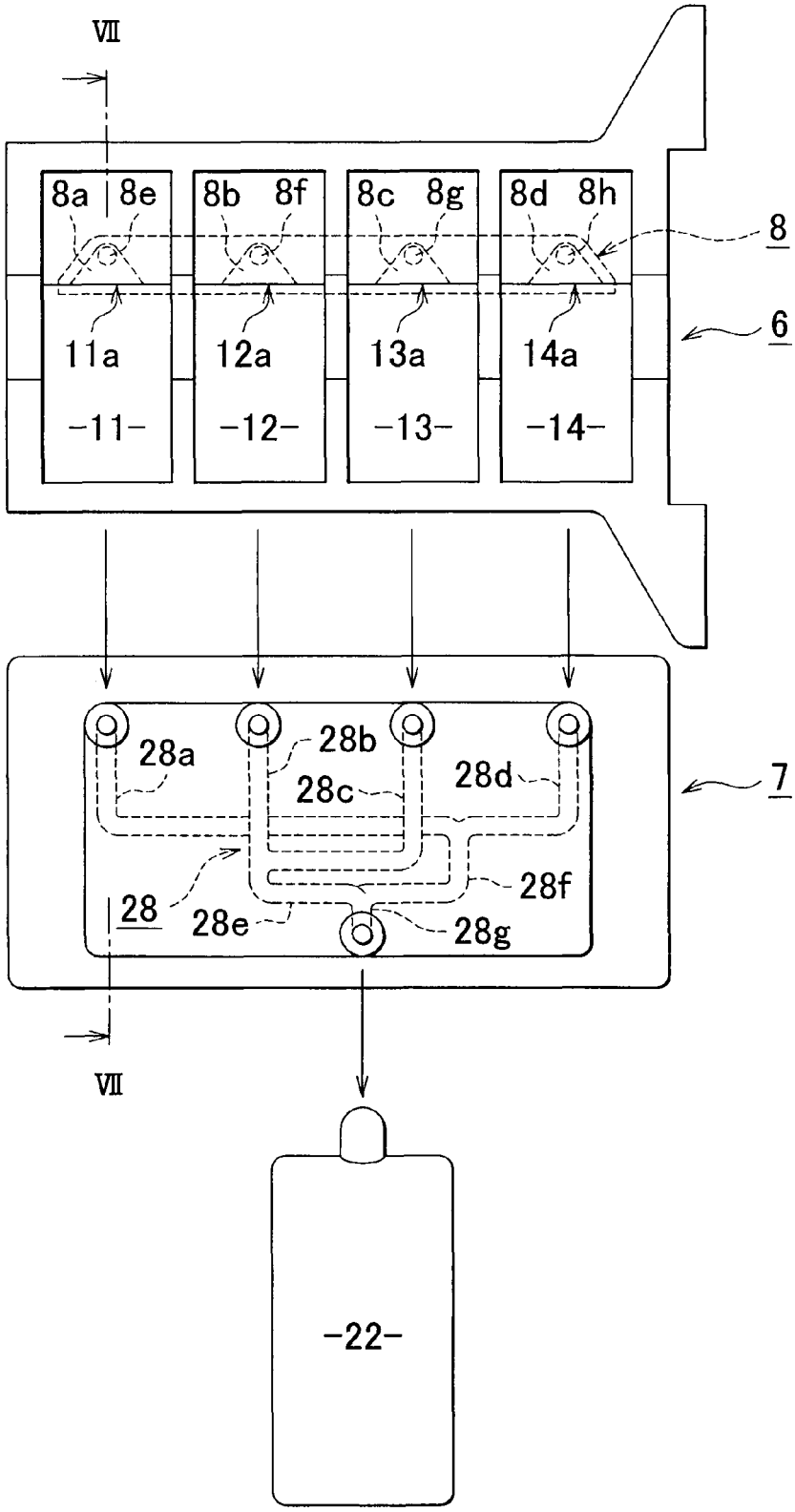
FIG. 6 is a plan view of the elements shown in FIG. 5.
Figure 7:
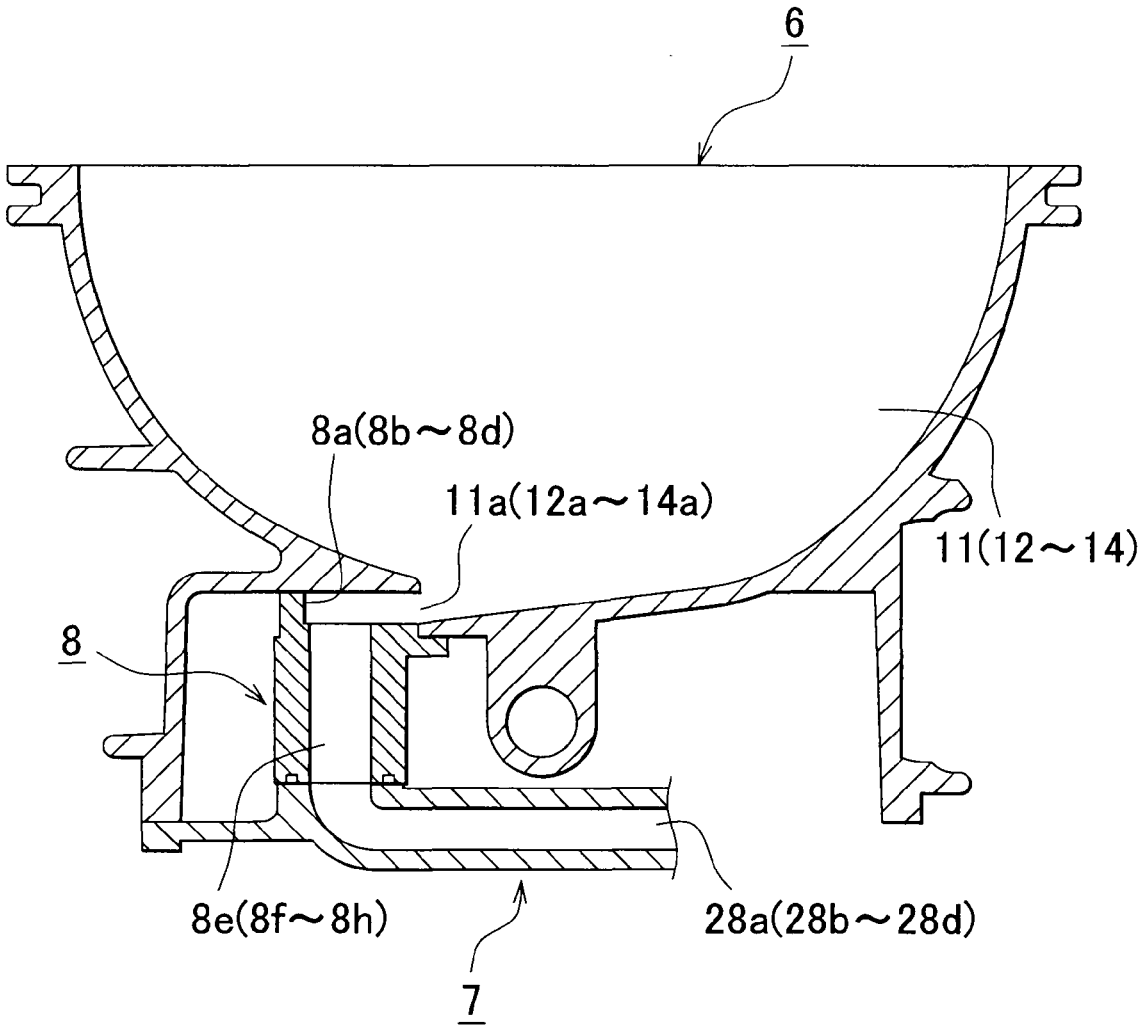
FIG. 7 is a cross sectional view taken along the line VII-VII of FIG. 6 as viewed in the direction of the arrows.

FIGS. 5 to 7 show a second embodiment of the present invention. The second embodiment is different from the above first embodiment in that a single scavenge pump 22 is used. Other structure and operations are basically the same as those of the first embodiment discussed above. Thus, only the differences from the above first embodiment will be described in detail here.

Specifically, in order to allow the single scavenge pump 22 to collect oil in the four partitioned crank chambers 11 to 14, an oil collection passage 28 with a 4-in-2-in-1 construction is used.

The oil collection passage 28 has such structure as obtained by further merging the respective downstream merged portions 25*c*, 26*c* of the two oil collection passages 25, 26 shown in the above first embodiment.

That is, the oil collection passage 28 has four upstream branched portions 28*a* to 28*d*, two intermediate merged portions 28*e*, 28*f*, and one downstream merged portion 28*g*.

The four upstream branched portions 28*a* to 28*d* of the oil collection passage 28 are separately connected to the lower openings of the four through holes 8*e* to 8*h* of the baffle plate 8, and the one downstream merged portion 28*g* of the oil collection passage 28 is connected to the suction port of the scavenge pump 22.

In the case of the second embodiment, the length and inner diameter of the four upstream branched portions 28*a* to 28*d* and the length and inner diameter of the intermediate merged portions 28*e*, 28*f* are set to such values that are required to sufficiently diminish pulsations of oil and blow-by gas due to pressure variations that occur in each of the crank chambers 11 to 14 so as not to propagate the pulsations to the scavenge pump 22. The length and inner diameter can be set empirically by experiments or the like.

According to the thus constructed second embodiment, it is possible to further reduce the cost, the weight, and the installation space of the lubrication system since a single scavenge pump 22 is used, as well as the functions and effects that are basically the same as those of the above first embodiment can be obtained. In addition, since only a single scavenge pump 22 is used, the burden on the engine 1 which drives the pump can be reduced.

Third Embodiment

Figure 8:
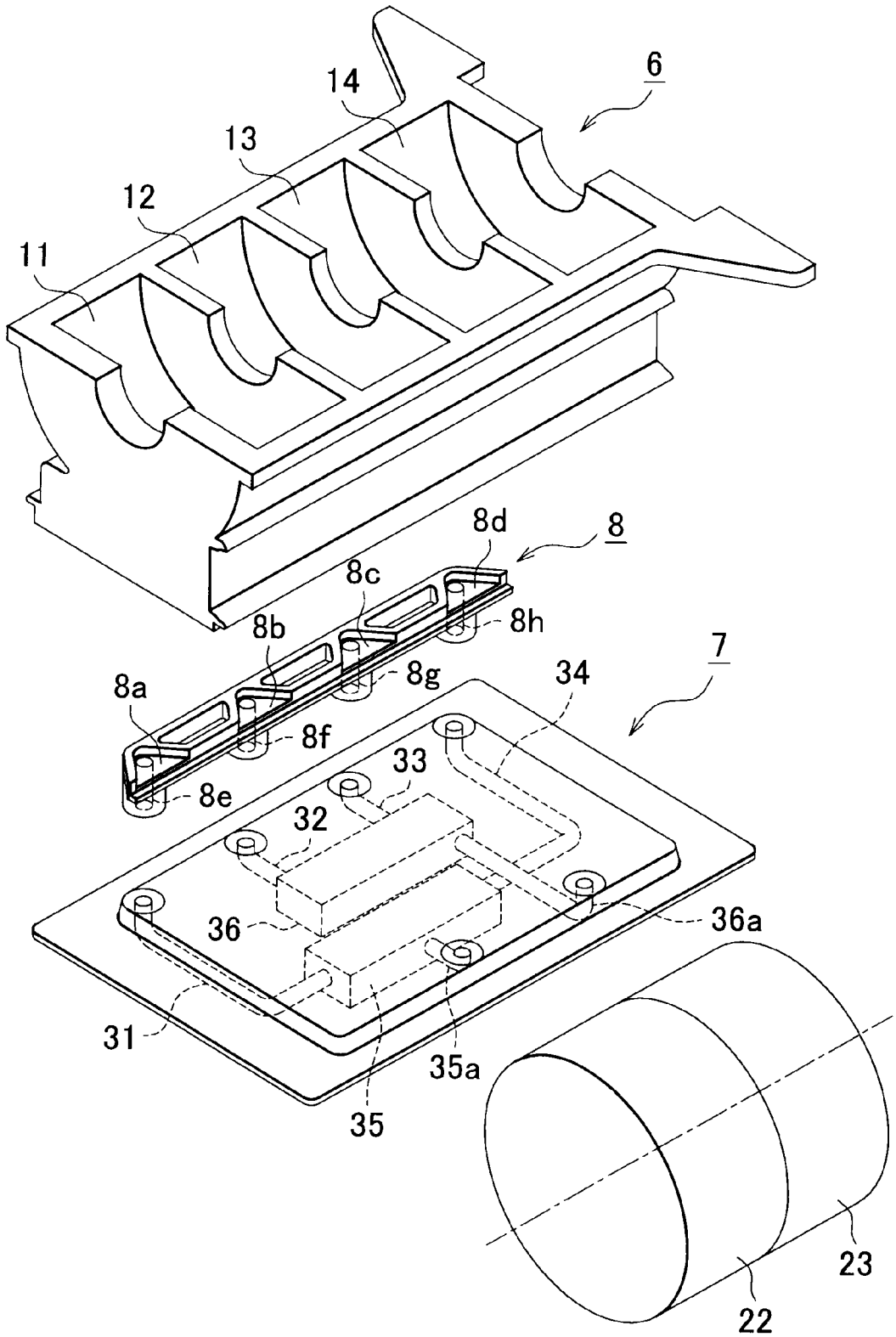
FIG. 8 is an exploded perspective view of elements forming an engine oil collection path in an engine lubrication system in accordance with a third embodiment.
Figure 9:
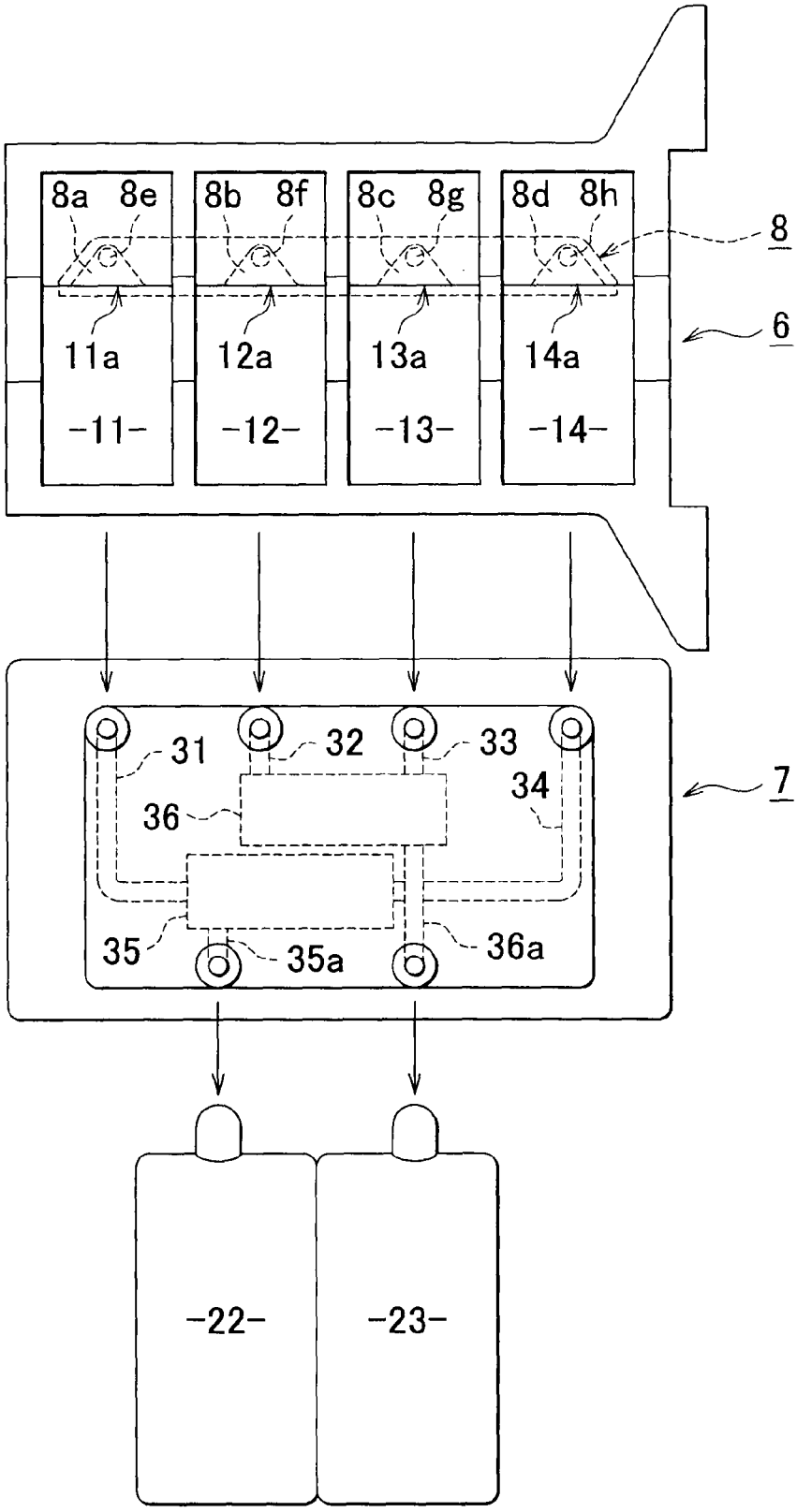
FIG. 9 is a plan view of the elements shown in FIG. 8.

FIGS. 8 and 9 show a third embodiment of the present invention. The third embodiment is different from the above first and second embodiments in the structure of the pressure variation suppression section. Other structure and operations are basically the same as those of the above first and second embodiments. Thus, only the differences from the above first and second embodiments will be described in detail here.

Specifically, as shown in FIGS. 8 and 9, oil collection passages 31, 34 are separately connected to the first crank chamber 11 and the fourth crank chamber 14 in which pistons move up and down in synchronization. The two oil collection passages 31, 34 are connected to a first chamber 35. The first chamber 35 is connected to the first scavenge pump 22 with a common passage 35*a* of the first chamber 35.

Meanwhile, as shown in FIGS. 8 and 9, oil collection passages 32, 33 are separately connected to the second crank chamber 12 and the third crank chamber 13 in which pistons move up and down in synchronization. The two oil collection passages 32, 33 are connected to a second chamber 36. The second chamber 36 is connected to the second scavenge pump 23 with a common passage 36*a* of the second chamber 36.

In this case, the pressure difference between the two crank chambers (11, 14), (12, 13) in each pair can be made minimum. In addition, pressure variations that occur in the two crank chambers (11, 14), (12, 13) in each pair can be prevented from interfering with each other, and pulsations of oil and blow-by gas due to the pressure variations that occur in the two crank chambers (11, 14), (12, 13) in each pair can be respectively diminished by the two chambers 35, 36.

This makes it possible to restrain or prevent oil from flowing back between two crank chambers (11, 14), (12, 13) in each of one pair of crank chambers 11, 14 and the other pair of crank chambers 12, 13.

In addition, oil and blow-by gas in the crank chambers 11 to 14 can be taken out into the two chambers 35, 36 and then be collected to the oil tank 21 smoothly with the two scavenge pumps 22, 23.

Here, the volume of the chamber 35 is set to a designated value that is required to diminish pulsations due to pressure variations. The volume can be set empirically by experiments or the like.

According to the thus constructed lubrication system in accordance with the third embodiment, the functions and effects that are basically the same as those of the above first embodiment can be obtained.

Fourth Embodiment

Figure 10:
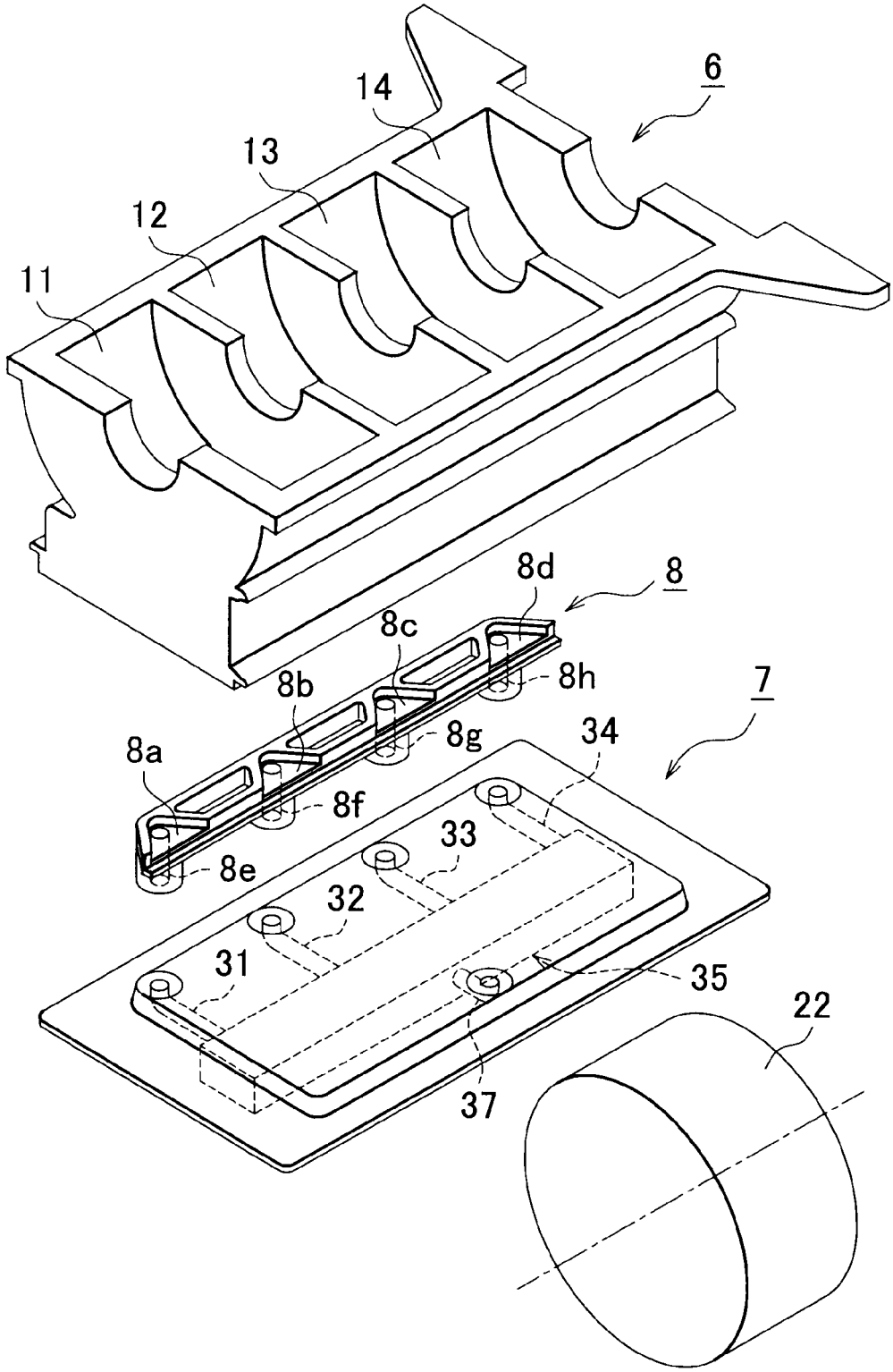
FIG. 10 is an exploded perspective view of elements forming an engine oil collection path in an engine lubrication system in accordance with a fourth embodiment.
Figure 11:
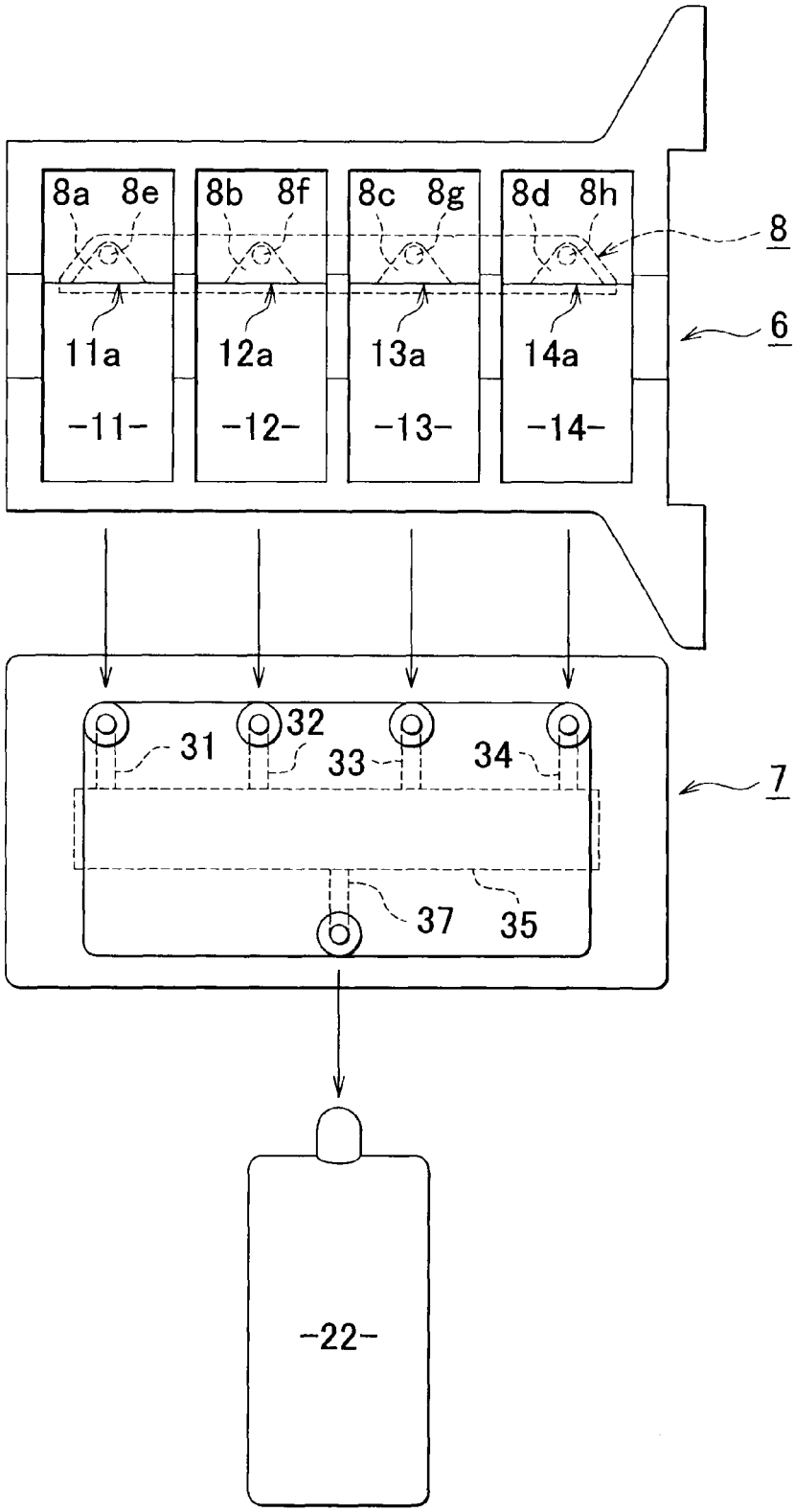
FIG. 11 is a plan view of the elements shown in FIG. 10.

FIGS. 10 and 11 show a lubrication system in accordance with a fourth embodiment of the present invention. The fourth embodiment is different from the above third embodiment in the number of the chambers 35. Other structure and operations are basically the same as those of the above third embodiment. Thus, only the differences from the above third embodiment will be described in detail here.

Specifically, as shown in FIGS. 10 and 11, the oil collection passages 31 to 34 are separately connected to the crank chambers 11 to 14. All the oil collection passages 31 to 34 are connected to a single chamber 35. The single chamber 35 is connected to a single scavenge pump 22 with a single common passage 37.

In this case, pressure variations that occur in each of the crank chambers 11 to 14 can be prevented from interfering with each other, and pulsations of oil and blow-by gas due to the pressure variations that occur in each of the crank chambers 11 to 14 can be diminished by the single chamber 35.

This allows oil and blow-by gas in the crank chambers 11 to 14 to be taken out into the chamber 35 and then collected to the oil tank 21 smoothly with the single scavenge pump 22.

Here, the volume of the chamber 35 is set to a designated value that is required to diminish pulsations due to pressure variations. The volume can be set empirically by experiments or the like.

According to the thus constructed fourth embodiment, the cost, the weight, and the installation space of the lubrication system can be further reduced since a single chamber 35 and a single scavenge pump 22 are used, as well as the functions and effects that are basically the same as those of the above third embodiment can be obtained. In addition, since only a single scavenge pump 22 is used, the burden on the engine 1 which drives the pump can be reduced.

It should be noted, however, that the present invention is not limited to the lubrication systems in accordance with the first through fourth embodiments discussed above. Other examples will be described below.

In the above embodiments, the present invention is applied to a lubrication system installed in an engine 1 for automobiles. However, the present invention may be applied lubrication systems installed in engines not only for automobiles but also for other purposes.

In the above embodiments, the inline 4-cylinder engine 1 is taken as an example. However, the number and arrangement of the cylinders are not specifically limited. For example, the engine may be a V-type engine.

In the case of V-type engines, in particular, the internal space of the crankcase 6 can be partitioned by bearing portions for the crankshaft 4 to form the same number of partitioned crank chambers as the number of the cylinders on one bank.

In the above embodiments, the scavenge pumps 22, 23 and the feed pump 24 are each a mechanical oil pump. However, they may each be electric oil pumps.

In the case where an electric oil pump is used, a required amount of oil can be supplied at an appropriate timing according to the running state of the vehicle, irrespective of the operating state of the engine 1.

Two scavenge pumps 22, 23 are used in the above first and third embodiments, while one scavenge pump 22 is used in the above second and fourth embodiments. However, the number of scavenge pumps to be used is not specifically limited. The number of scavenge pumps to be used may be at least one and less than the number of partitioned crank chambers, and may be any number in that range.

In the above first embodiment, two oil collection passages 25, 26 with a 2-in-1 construction are used. However, the number of oil collection passages is not specifically limited, and may be any number.

Now, a description will be made of the case where the number of crank chambers are an odd number, for example five, such as in a V-10 engine or an inline 5-cylinder engine, for example.

It is considered that, although not shown, one scavenge pump is connected to one crank chamber positioned centrally in the direction in which the cylinders are arranged (crankshaft direction), two other crank chambers between which pressure difference is minimum are connected to another pump using an oil collection passage with a 2-in-1 construction, and the remaining two crank chambers between which pressure difference is minimum are connected to still another pump using an oil collection passage with a 2-in-1 construction. In this case, three scavenge pumps are used in total.

In this way, the functions and effects that are basically the same as those of the above first embodiment can be obtained. Also, the technical concepts of the present invention described in the above second to fourth embodiments can be applied to such engines.

In the above embodiments, the oil collection passages 25, 26, 28, 31 to 34 are formed integrally in the oil pan 7. However, they may be formed separately from the oil pan 7.

Moreover, the oil collection passages 25, 26, 28, 31 to 34 are formed as holes that are formed inside the oil pan 7 in the above embodiments. However, the oil collection passages may be formed as follows. The oil pan 7 itself includes two plate-like members, which are each formed with grooves corresponding to the oil collection passages 25, 26, 28, 31 to 34. The two plate-like members are mated together in such a manner that the grooves in both the plate-like members agree with each other to form holes as the oil collection passages discussed above.

While the invention has been described with reference to example embodiments thereof, it is to be understood that the invention is not limited to the described embodiments or constructions. On the other hand, the invention is intended to cover various modifications and equivalent arrangements. In addition, while the various elements of the disclosed invention are shown in various example combinations and configurations, other combinations and configurations, including more, less or only a single element, are also within the scope of the appended claims.

What is claimed is:

1. An engine lubrication system for a multi-cylinder engine, comprising:

a plurality of crank chambers that are partitioned by crankshaft bearing portions of the engine;

a number of pumps that take out oil from a lower portion of the engine, the number of the pumps being at least one and less than a number of the crank chambers;

an oil storage section that temporarily stores the oil taken out from the lower portion of the engine;

a lubrication part that supplies the oil in the oil storage section to a portion to be lubricated of the engine; and a pressure variation suppression section including oil collection passages that are respectively provided for the crank chambers, a designated number of the oil collection passages being merged and connected to at least one of suction ports of the pumps, the pressure variation suppression section being provided between the suction ports of the pumps and the designated number of the crank chambers to be merged, and the pressure variation suppression section suppressing pressure variations in the crank chambers by only the crank chambers between which pressure difference is minimum being permanently merged via an always opened oil flow path through the merged oil collection passages or by only the crank chambers in which pressure variations are in a same phase being permanently merged via the always opened oil flow path through the merged oil collection passages.

2. The engine lubrication system according to claim 1, wherein the crank chambers between which pressure difference is minimum are the designated number of the crank chambers to be merged, and the pressure variation suppression section includes the oil collection passages that are connected to the respective crank chambers such that the oil collection passages have a designated length and a designated inner diameter that are required to suppress pressure variations in the respective crank chambers.

3. The engine lubrication system according to claim 1, wherein the oil collection passages have the same length from a point at which each oil collection passage is connected to a corresponding crank chamber to a point at which the oil collection passages are merged.

4. The engine lubrication system according to claim 1, wherein the crank chambers between which pressure difference is minimum are the designated number of the crank chambers to be merged, the pressure variation suppression section includes chambers to which downstream sides of the oil collection passages to be merged are respectively connected, the chambers having a specific volume that is required to suppress pressure variations in the crank chambers corresponding to the oil collection passages, and the chambers are connected to the suction ports of the pumps though a single common passage.

5. The engine lubrication system according to claim 1, wherein the oil collection passages are formed integrally in a plate-like member attached to a lower side of the crank chambers.

6. The engine lubrication system according to claim 5, wherein the plate-like member in which the oil collection passages are formed is an oil pan or a lower plate.

7. The engine lubrication system according to claim 1, wherein in the case where an even number of the crank chambers are provided, every two crank chambers between which pressure difference is minimum are paired, and the number of the pumps is the same as the number of pairs of the crank chambers.

8. The engine lubrication system according to claim 1, wherein in the case where an odd number of the crank chambers are provided, one pump is connected to one crank chamber positioned centrally in a direction in which cylinders are arranged, and every two other crank chambers between which pressure difference is minimum are each connected to one pump using an oil collection passage with a 2-in-1 construction.

9. The engine lubrication system according to claim 1, wherein the pumps are each a mechanical oil pump.

10. The engine lubrication system according to claim 1, wherein the pumps are each an electric oil pump.

11. An engine lubrication system for a multi-cylinder engine, comprising:

a plurality of crank chambers that are partitioned by crankshaft bearing portions of the engine;

means for pumping that take out oil from a lower portion of the engine, a number of the pumping means being at least one and less than a number of the crank chambers;

means for temporarily storing the oil taken out from the lower portion of the engine;

means for lubricating that supplies the oil in the temporary storage means to a portion to be lubricated of the engine; and means for suppressing pressure variation including means for collecting oil that are respectively provided for the crank chambers, a designated number of the oil collecting means being merged and connected to at least one of suction ports of the pumping means, the means for suppressing pressure variation being provided between the suction ports of the pumping means and the designated number of the crank chambers to be merged, and the pressure variation suppression means suppressing pressure variations in the crank chambers by only the crank chambers between which pressure difference is minimum being permanently merged via an always opened oil flow path through the merged oil collecting means or by only the crank chambers in which pressure variations are in a same phase being permanently merged via the always opened oil flow path through the merged oil collecting means.

* * * * *